United States Patent [19]

Flammann

[11] Patent Number: 4,598,620

[45] Date of Patent: Jul. 8, 1986

[54] HOUSEHOLD APPLIANCE WITH AN ADJUSTABLE GUARD FOR A ROTARY TOOL

[75] Inventor: Norbert Flammann, Solingen, Fed. Rep. of Germany

[73] Assignee: Robert Krups Stiftung & Co. KG, Solingen, Fed. Rep. of Germany

[21] Appl. No.: 665,128

[22] Filed: Oct. 26, 1984

[30] Foreign Application Priority Data

Nov. 14, 1983 [DE] Fed. Rep. of Germany ..... 3341168

[51] Int. Cl.[4] ..... B26D 7/22

[52] U.S. Cl. ..... 83/399; 83/397; 83/478; 83/DIG. 1

[58] Field of Search ..... 83/397, 399, 400, 478, 83/545, 546, DIG. 1

[56] References Cited

U.S. PATENT DOCUMENTS 3,704,736 12/1972 Pratley ..... 83/397

4,070,941 1/1978 Lorenz ..... 83/701 X 4,520,703 6/1985 Speckhart ..... 83/478

*Primary Examiner*—James M. Meister

*Attorney, Agent, or Firm*—Peter K. Kontler

[57] ABSTRACT

A household slicing machine wherein a disc-shaped knife is rotatable in a vertical plane in response to starting of an electric motor as a result of depression of a trip which is mounted in the housing of the slicing machine. The trip can be depressed only when a detachable guard for the knife is held in an intermediate position in which the guard and an abutment for the foodstuff to be sliced define a gap wide enough for movement of the foodstuff into the range of the rotating knife. The guard causes a spring-biased blocking device to prevent depression of the trip when the guard is shifted to a position in which it cooperates with the abutment to prevent access to the knife as well as when the guard is actually detached or is held in a position in which it is detachable from the housing.

20 Claims, 12 Drawing Figures

HOUSEHOLD APPLIANCE WITH AN ADJUSTABLE GUARD FOR A ROTARY TOOL

CROSS-REFERENCE TO RELATED CASES

The appliance which is disclosed in the present application is or can be identical with the appliance of the commonly owned copending patent application Ser. No. 665,017 filed Oct. 26, 1984 by Norbert FLAMMANN et al. for "Household appliance and an adjustable guard for its tool". Furthermore, the appliance which is disclosed in the present application is similar to the appliance which is described and shown in the commonly owned copending tent application Serial No. 664,976 filed Oct. 26, 1984 by Norbert Flammann for "Adjustable household slicing machine" and in the commonly owned copending patent application Ser. No. 665,366 filed Oct. 26, 1984 by Stefan Henn et al. for "Adjustable slicing machine for bread and other types of foodstuffs".

BACKGROUND OF THE INVENTION

The present invention relates to appliances in general, and more particularly to improvements in appliances of the type wherein a mobile tool can be shielded by a guard to reduce the likelihood of injury to the operator. Typical examples of such appliances are household slicing machines for bread or other foodstuffs wherein a rotary disc-shaped severing tool is normally installed in a vertical plane and the housing of the machine confines an electric motor which can be started to rotate the tool.

German Utility Model No. 7 611 681 (corresponding to U.S. Pat. No. 4,070,941) discloses a household slicing machine with a protective guard or shroud which is detachable from the housing of the machine and permits the actuating means for the motor switch to start the motor only when the guard is properly attached to the housing. The actuating means comprises a trip for the switch, and such trip is reciprocably mounted in the upper part of the housing of the slicing machine. A barrier is shiftable at a level below the lower end of the trip to oppose the depression of the trip and closing of the motor switch when it extends into the path of downward movement of the trip. A spring is provided to urge the barrier toward the front wall of the housing and into the path of downward movement of the trip. The guard or shroud of the machine which is disclosed in the Utility Model is designed to overlie portions of the rotary disc-shaped slicing knife and has lugs and holding fingers which can be inserted through openings provided therefor in the housing of the slicing machine. One such opening is located in the region of the barrier so that, when the guard is properly affixed to the housing, a selected one of its holding fingers moves the barrier away from the path of downward movement of the trip and the latter can be depressed in order to complete the circuit of the motor which then drives the slicing knife. The selected holding finger of the guard then overcomes the bias of the spring which urges the barrier to its blocking position, i.e., into the path of movement of the trip in a direction to close the associated switch and to thus complete the circuit of the motor.

The just described appliance exhibits the advantage that the motor cannot be started as long as the guard is not properly affixed to the housing. The aforementioned spring ensures that the barrier reassumes its blocking position in immediate response to separation of the guard from the housing. However, the just described appliance also exhibits certain drawbacks. For example, the guard cannot completely conceal (i.e., prevent access to) the slicing knife when it is properly affixed to the housing. Thus, the motor for the slicing knife can be started as soon and as long as the guard is properly attached to the housing. This can lead to injuries if the motor is started accidentally when the appliance is not intended to be used. Moreover, it is not possible to shield the slicing knife from contamination when the guard is properly applied but the appliance is not in use for extended periods of time.

OBJECTS AND SUMMARY OF THE INVENTION

An object of the invention is to provide a novel and improved appliance with a guard for a power-driven tool which is constructed and assembled in such a way that the mobility of the guard with reference to its support is not limited to mere attachment to and separation from the support.

Another object of the invention is to provide an appliance which exhibits all advantages of the aforediscussed conventional appliances but whose versatility, especially as concerns the function of the guard, is much greater than that of the conventional appliances.

A further object of the invention is to provide an appliance whose manipulation is safer than that of conventional appliances and whose guard can effectively shield the mobile tool or tools from contaminants when such guard is affixed to the housing of the appliance.

An additional object of the invention is to provide a novel and improved protective guard or shroud for use in an appliance of the above outlined character.

Another object of the invention is to provide a novel and improved housing for the prime mover, tool, protective guard and other components of the above outlined appliance.

A further object of the invention is to provide the appliance with novel and improved means for blocking the actuating means for the motor which drives the tool or tools when the guard is detached from the housing as well as in certain other position or positions of the guard.

Still another object of the invention is to provide an appliance, such as a household slicing machine, which embodies the above outlined housing, protective guard and blocking means.

An additional object of the invention is to provide a novel and improved method of controlling the circuit for the electric motor which drives the tool or tools of a household appliance in dependency on the position of the guard for the tool or tools.

Another object of the invention is to provide a novel and improved household slicing machine for bread and/or other types of foodstuffs.

The invention resides in the provision of an appliance, such as a household slicing machine, which comprises a support, a tool which is movably mounted in or on the support, and a protective guard or shroud for the tool. The guard is movable relative to the support between a first position in which it prevents access to the tool and a second position in which the tool is adequately exposed for use. The appliance further comprises actuating means for initiating the movement of the tool relative to the support, and such actuating means is movable between an operative and an inoperative position. Still further, the appliance comprises means for blocking the movement of the actuating means from the inoperative position to the operative position in response to movement of the guard to its first position. If the tool is a rotary disc-shaped tool which is disposed in a first plane, the guard preferably includes a substantially plate-like member and the support includes guide means defining for the member of the guard a path for movement of such member between the first and second positions in a second plane which is at least substantially parallel to the first plane. Such planes are or can be vertical planes.

The appliance can further comprise means for movably coupling the guard to its support in the first and second positions of the guard, and the latter is preferably further movable to a third position in which the coupling means allows for its separation from the support. The coupling means can include or it can constitute the aforementioned guide means. Such appliance preferably further includes displacing means (e.g., a coil spring) for yieldably urging the blocking means to a blocking position in which the blocking means prevents the actuating means from leaving its inoperative position. The displacing means is arranged to maintain the blocking means in the blocking position when the guard assumes its third position so that the actuating means can leave the inoperative position only in the second position of the guard. The second position is preferably located between the first and third positions, i.e., the guard must advance in a first direction during movement from the second to the first position and in a second direction, counter to the first direction, during movement from the second to the third position. The blocking means can include follower means and the guard then comprises cam means. The follower means tracks the cam means during movement of the guard between the first and second positions. The support can include a housing having a wall which is adjacent to the guard when the latter assumes its first and second positions. As mentioned above, the aforementioned guide means can constitute the means which movably couples the guard to the housing, and such guide means can but need not include a portion of the cam means and a track provided on the wall or another part of the housing and releasably engaging a portion of the guard. A cam face of the cam means is engaged by the follower means, at least while the guard is held in the second position, and such cam face has a portion which shifts the follower means and hence the entire blocking means in response to movement of the guard from the first to the second position so that the blocking means ceases to block the movement of the actuating means from the inoperative to the operative position.

The guard is or can constitute a one-piece member which is preferably made of a suitable synthetic plastic material. Such member is preferably provided with handgrip means to facilitate its shifting between the first, second and third positions.

The aforementioned wall of the housing is preferably detachable, and such wall preferably comprises stop means for the blocking means, e.g., for the aforementioned follower means of the blocking means. The displacing means biases the blocking means against the stop means of the removable wall in the first position of the guard, and the aforementioned portion of the cam face on the guard serves to shift the blocking means from blocking position in response to movement of the guard from the first or third position toward the second position. The blocking means blocks the movement of the actuating means from the inoperative to the operative position when the displacing means is free to urge it into actual contact with the stop means of the removable wall.

The actuating means is preferably mounted in or on the support and the blocking means can comprise a reciprocable locking bolt which is mounted in the support and has a front end portion constituting the aforementioned follower means and a rear end portion which is acted upon by the displacing means so that the front end portion tends to move into engagement with the stop means of the removable wall. The blocking means preferably further comprises a projection (e.g., an arm which extends at right angles from and shares the movements of the locking bolt) which serves to move into the path of movement of the actuating means from the inoperative to the operative position when the guard assumes its second position. The aforementioned cam means of the guard constitutes a means for shifting the locking bolt against the opposition of the displacing means in response to movement from the first to the second position whereby the front end portion moves away from the stop means of the removable wall and the arm is moved away from the path of movement of the actuating means from the inoperative to the operative position. For accurate guidance of the blocking means, the removable wall of the housing can be provided with a bearing through which a portion of the bolt extends. The housing of the appliance can have a socket for a portion of the displacing means; such socket can constitute an annular protuberance provided on a second wall of the housing opposite the removable wall.

The tool is preferably driven by electric motor means which is or can be installed in the housing, and the latter preferably further accommodates switch means which is in circuit with the motor means and can complete such circuit when it is operated by the actuating means, i.e., when the actuating means is moved from the inoperative to the operative position.

Abutment means (e.g., in the form of a plate which is adjustably mounted on the working platform of the appliance) can be provided to cooperate with the guard in preventing access to the tool in the first position of the guard.

The novel features which are considered as characteristic of the invention are set forth in particular in the appended claims. The improved appliance itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic perspective view of the front side of an appliance which constitutes a household slicing machine and embodies the present invention, the guard being shown in its second position in which a portion of the rotary severing tool of the appliance is accessible for the slicing of bread or the like;

DESCRIPTION OF THE PREFERRED EMBODIMENTS

Figure 1:
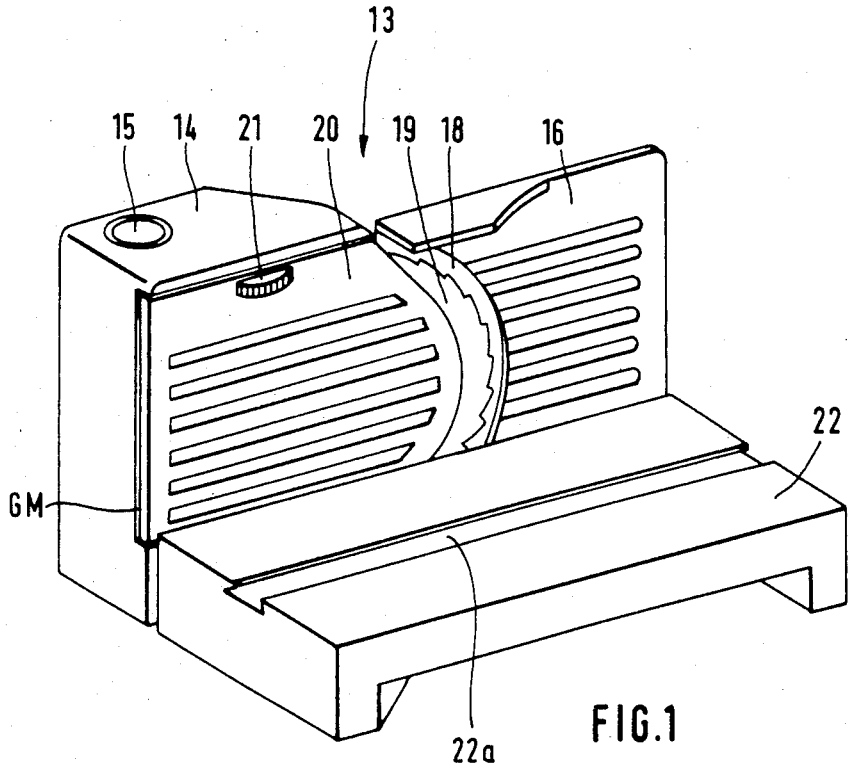
Figure 2:
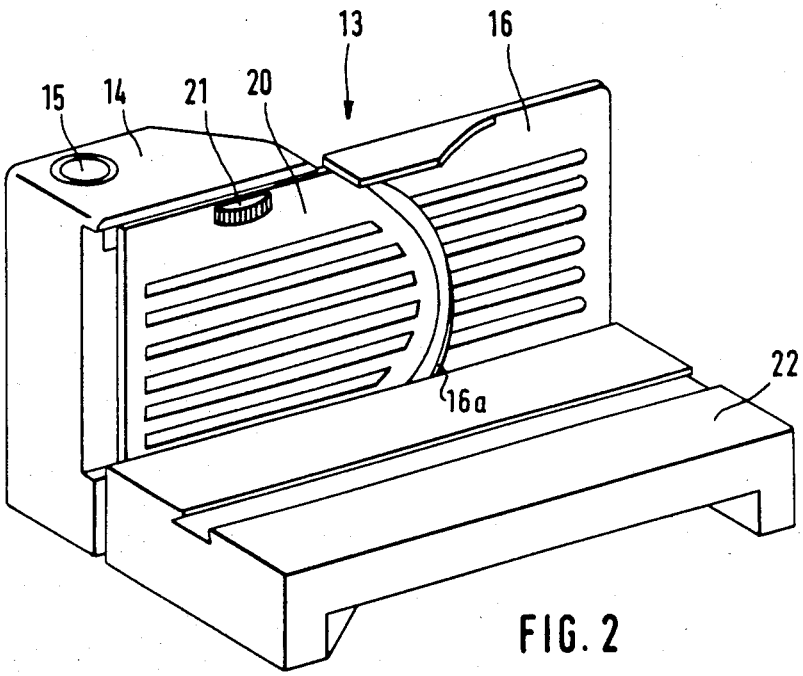
FIG. 2 is a similar perspective view but showing the guard in its first position in which the guard cooperates with an adjustable abutment to prevent access to the tool.
Figure 3:
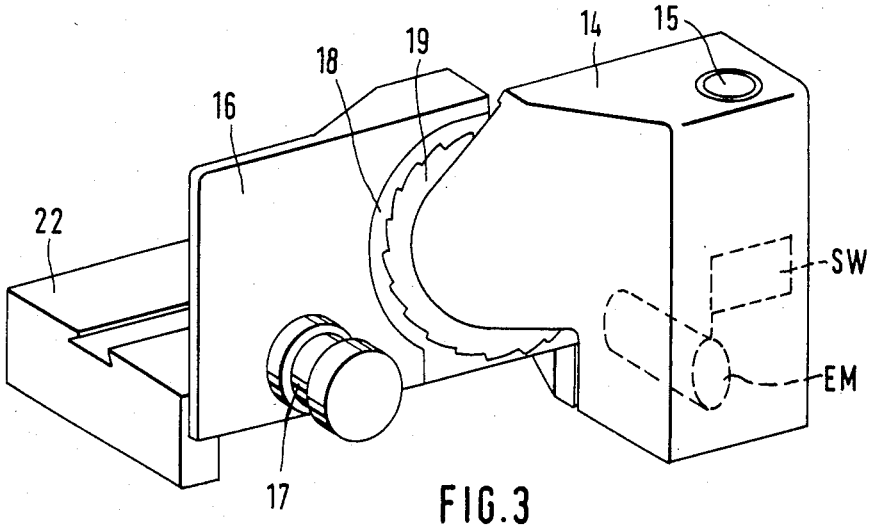
FIG. 3 is a schematic perspective view of the rear side of the appliance, showing the adjusting means for the abutment.

Referring first to FIGS. 1 to 3, there is shown an appliance 13 which constitutes a slicing machine for bread or other types of foodstuffs. The appliance 13 comprises a housing or support 14 which confines an electric motor EM (indicated in FIG. 3 by broken lines) and a switch SW which is in circuit with the motor and must be closed to thus complete the motor circuit and set in rotation a rotary tool 19 in the form of a disc-shaped knife having a toothed cutting edge. The transmission between the output shaft of the motor EM and the shaft of the tool 19 is not specifically shown in the drawing. The appliance 13 can be provided with means for varying the speed of the tool 19, e.g., by utilizing a variable speed transmission. The means for actuating the switch SW so as to complete the circuit of the motor EM includes an elongated trip 15 which is reciprocably installed in the housing 14 and must be depressed by hand in order to close the switch SW. In the illustrated embodiment, the upper end portion of the trip 15 is accessible by way of an opening in the top wall of the housing 14.

The appliance 13 further comprises an upright plate-like abutment 16 which is adjustably secured to a bridge-like working platform 22 of the appliance. The platform 22 is located in front of the housing 14 and carries an adjusting device 17 (see FIG. 3) which serves to move the plane of the abutment 16 nearer to or further away from the vertical plane of the tool 19 and to thus reduce or increase the thickness of slices which can be severed from a loaf of bread or from a sausage or salami which is placed onto the platform 22 so that it bears against the front side (shown in FIGS. 1 and 2) of the abutment 16 and is thereupon moved in a direction to the left, as viewed in FIG. 1 or 2. The slice which is severed from the loaf passes through an arcuate sickle-shaped slot 18 between the cutting edge of the tool 19 and the adjacent concave edge face 16a of the abutment 16 and the slice emerges from such slot at the rear side of the housing 14, i.e., at the side which is shown in FIG. 3.

The manner in which the tool 19 can be separated from the output element of the transmission which receives torque from the motor EM (so that the tool can be inspected, cleaned or replaced) is not specifically shown in the drawing.

In the illustrated appliance 13, the tool 19 is mounted in a vertical plane which is parallel to the plane of the abutment 16 as well as to the general plane of a novel and improved protective shroud or guard 20 which is separably and movably secured to a detachable front wall 27 (see FIGS. 7 to 12) of the housing 14. FIG. 2 shows the guard 20 in a first position in which it cooperates with the abutment 16 to fully prevent access to the tool 19 from the front side of the housing 14. FIG. 1 shows the guard 20 in a second position in which the tool 19 is exposed sufficiently to allow for its use as a means for severing bread or another foodstuff, and FIG. 10 shows the guard 20 in a detached position adjacent to a third position in which latter position the guard also permits access to the tool 19 but the motor EM for the tool 19 cannot be started, the same as in the first position (FIG. 2) of the guard.

Figure 4:
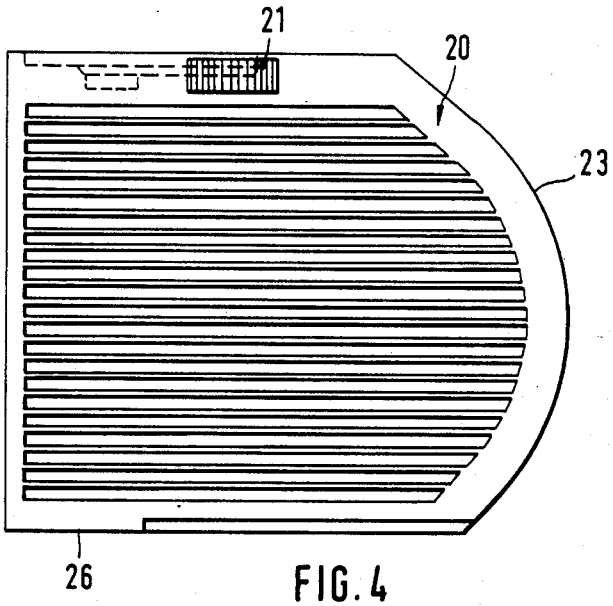
FIG. 4 is an enlarged front elevational view of the guard.
Figure 5:
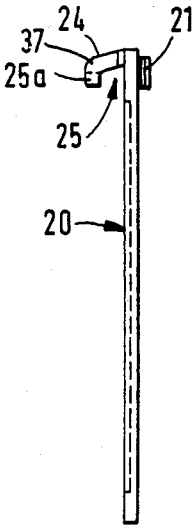
FIG. 5 is an end elevational view of the guard as seen from the left-hand side of FIG. 4.
Figure 6:
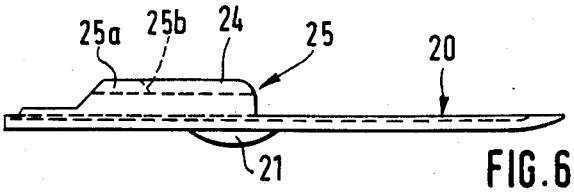
FIG. 6 is a plan view of the guard which is shown in FIG. 4.

As shown in FIGS. 4, 5 and 6, the illustrated guard 20 is a one-piece member which is preferably made of a suitable synthetic plastic material. Such one-piece member is bounded by straight edge faces at three of its sides and by a convex edge face 23 at the fourth side. When the guard 20 is moved to the first position of FIG. 12, such convex edge face 23 is sufficiently close to (or can actually contact) the adjacent concave edge face 16a of the abutment 16 to prevent access to the tool 19 from the front side of the appliance 13. The radii of curvature of the edge faces 16a and 23 can equal or approximate the radius of the tool 19.

The straight lower marginal portion 26 of the guard 20 is receivable in a complementary channel or other suitable guide means GM of the housing 14 to ensure that the plate-like member which constitutes the guard 20 is reciprocable in a vertical plane which is parallel to the plane of the tool 19. The guide means GM is preferably disposed between the detachable front wall 27 of the housing 14 and the adjacent portion of the working platform 22. The latter is rigid with and can be said to constitute a component part of the housing 14. The reference character 22a denotes in FIG. 1 a dovetailed groove which is provided in the upper side of the platform 22 and can receive a reciprocable carriage for the foodstuff to be sliced or for the remnant of such foodstuff.

The surfaces surrounding the guide means GM of the housing 14 and the lower marginal portion 26 of the guard 20 can be said to constitute a means for releasably coupling the guard 20 to the housing 14 in such a way that the guard is movable in a plane which is parallel to the vertical plane of the tool 19.

The guard 20 further comprises a cam face 24 which is provided on an elongated cam 25 having in part a substantially L-shaped cross-sectional outline (see FIG. 5). The cam 25 extends from one side of the upper marginal portion of the guard 20. When the guard 20 is properly mounted in the housing 14, the cam 25 faces toward the inner side of the rear wall 14a of the housing 14. The other or outer side of the guard 20 is provided with a handgrip means 21 in the form of a substantially semicircular knurled projection which can be manipulated by hand in order to move the guard in its vertical plane between the aforementioned first, second and third positions. The second position (shown in FIG. 11) is disposed between the first and third positions, i.e., the handgrip means 21 must be actuated to shift the guard 20 in a first direction (to the right, as viewed in FIG. 11) in order to move the guard to the first position of FIG. 12 and in a second direction (to the left, as viewed in FIG. 11) counter to the first direction in order to move the guard to the third position (namely to a position at a level slightly above that shown in FIG. 10).

Figure 7:
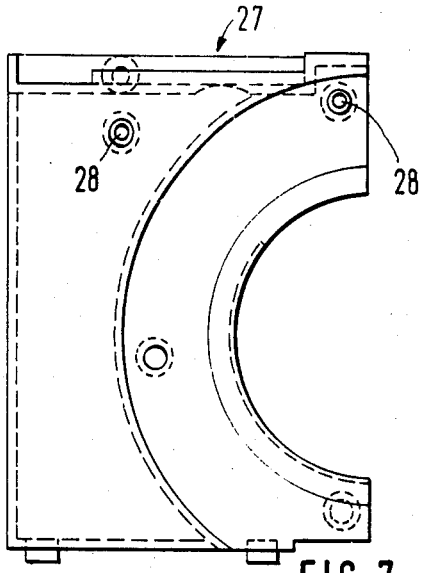
FIG. 7 is an enlarged front elevational view of a detachable front wall of the housing which constitutes the support of the improved appliance.
Figure 8:
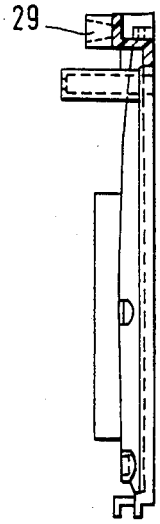
FIG. 8 is a side elevational view of the wall.
Figure 9:
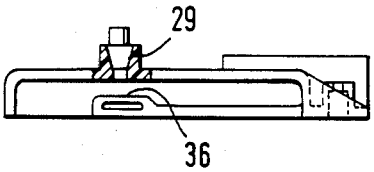
FIG. 9 is a plan view of the wall.
Figure 10:
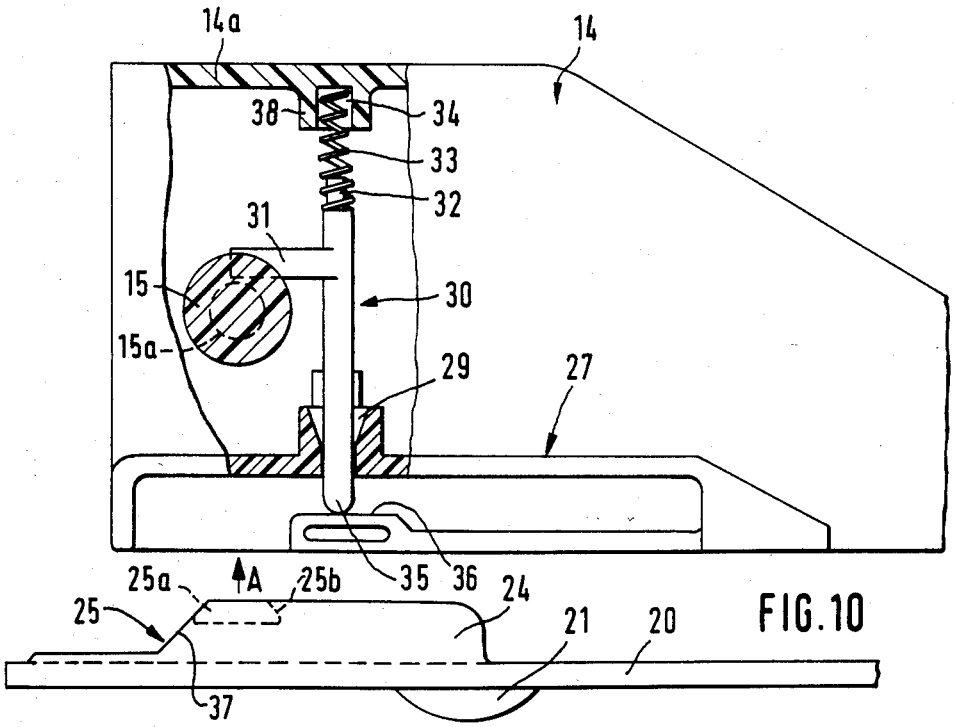
FIG. 10 is a fragmentary plan view of the appliance, with the guard detached from the front wall of the housing and with the front end portion of the locking bolt in abutment with a stop of the front wall so that the actuating means cannot leave its inoperative position, certain parts of the appliance being shown in section.

The details of the front wall 27 of the housing 14 are shown in FIG. 7, 8 and 9. When properly attached to the remaining major part of the housing 14, this front wall is adjacent to the inner side of the guard 20 when the latter assumes the first position of FIG. 12 or the second position of FIG. 11 (as well as the third position in which the guard can be readily separated from the housing 14). The means for separably securing the front wall 27 to the major part of the housing 14 includes screws (not specifically shown) or other types of fasteners which extend through suitably distributed holes or bores 28 in the wall 27. The inner side of the front wall 27 (i.e., that side which faces the interior of the housing 14 and the motor EM therein) is formed with an annular bearing 29 having a tapering axial passage for the rounded front end portion or follower 35 of an elongated locking bolt 30 forming part of means for blocking the movement of the trip 15 to the operative position (in order to close the switch SW for the motor EM) when the guard 20 is detached from the housing 14, when the guard assumes its third position or when the guard assumes its first position. The rear end portion 32 of the locking bolt 30 has a reduced diameter and extends into the foremost convolutions of a displacing means here shown as a helical tension spring 33 which reacts against the rear wall 14*a* of the housing 14 and urges the bolt 30 forwardly, i.e., toward the inner side of the guard 20. The rearmost convolutions of the spring 33 extend into a blind bore or hole 34 of an annular socket 38 which extends fowardly from the inner side of the rear wall 14*a* of the housing 14. The foremost convolution of the spring 33 bears against an annular shoulder which is located between the smaller-diameter rear end portion 32 and the larger-diameter major portion of the locking bolt 30.

The means for blocking the movement of the trip 15 to its operative position in certain positions of the guard 20 further comprises a projection 31 in the form of a straight arm which is integral with or separably affixed to and extends at right angles to a central portion of the bolt 30. The arm 31 can enter a circumferential groove 15*a* in the peripheral surface of the reciprocable trip 15 and, when it is free to enter such groove under the action of the spring 33, the trip 15 is held against depression, i.e., against movement from the inoperative position to the operative position in which the lower end portion of the trip closes the switch SW to thereby complete the circuit of the motor EM and set the tool 19 in rotary motion at a speed which is selected by the ratio of the transmission. The length of the arm 31 can be a small fraction of the length of the bolt 30.

FIG. 10 shows that the front wall 27 is already secured to the major part of the housing 14. This front wall has a stop 36 which is located in front of the bearing 29 and is engaged by the front end portion or follower 35 of the locking bolt 30 when the spring 33 is free to expand. In FIG. 10, the spring 33 is free to expand because the guard 20 is still detached from the housing 14. The arm 31 on the bolt 30 extends into the circumferential groove 15*a* of the trip 15 so that the motor EM cannot be started.

Figure 11:
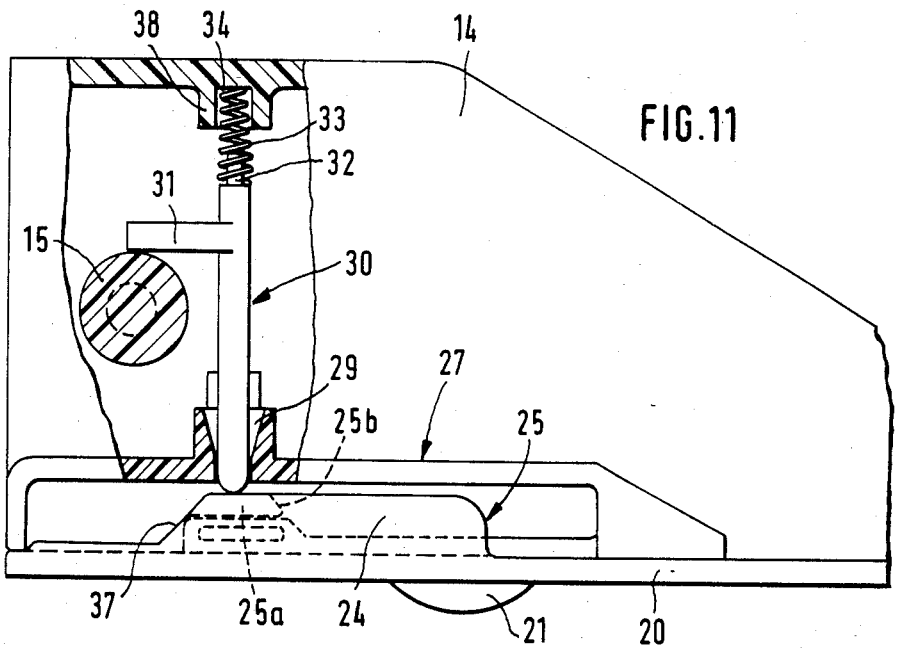
FIG. 11 illustrates the structure of FIG. 10 but with the guard shown in the second position in which its cam means maintains the blocking means out of engagement with the stop means of the front wall so that the actuating means is free to leave its inoperative position.
Figure 12:
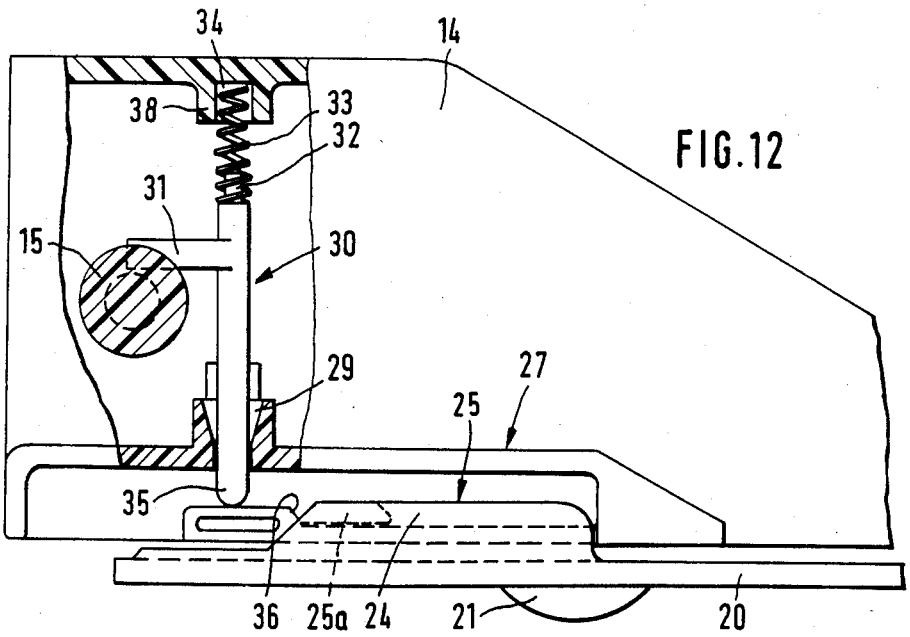
FIG. 12 is a view similar to that of FIG. 11 but showing the guard in the third position in which the arm on the locking bolt again prevents the movement of actuating means from its inoperative position.

If the guard 20 is thereupon moved upwardly (arrow A), as viewed in FIG. 10, so that its lower marginal portion 26 can enter the aforementioned guide means GM between the front wall 27 and the working platform 22, the cam 25 moves rearwardly and beyond the stop 36 of the front wall 27 but the follower 35 of the bolt 30 is not immediately depressed against the opposition of the spring 33, i.e., the bolt 30 is not immediately caused to assume the position which is shown in FIG. 11. For this, the entire bolt 30 must be moved nearer to the rear wall 14*a* of the housing 14 and the arm 31 must be expelled from the circumferential groove 15*a* of the trip 15 so that the operator of the appliance 13 can depress the trip 15 in order to start the motor EM via switch SW. As can be seen in FIGS. 10 to 12, the cam 25 comprises a relatively short downwardly extending portion 25*a* which is not in register with the follower 35 of the bolt 30 when the guard 20 is moved to its third position (to the left of the second position shown in FIG. 11). Thus, and referring again to FIG. 10, if the guard 20 is simply moved upwardly (as indicated by the arrow A), the cam portion 25*a* is located to the left of the follower 35 so that the latter continues to abut against the stop 36 of the front wall 27 and the arm 31 continues to block the movement of the trip 15 from its inoperative position. In other words, the cam 25 is not effective in the third position of the guard 20 because the follower 35 of the bolt 30 then continues to bear against the stop 36 under the action of the spring 33.

In order to expel the arm 31 from the groove 15*a*, it is necessary to shift the guard 20 (preferably by pushing or pulling the handgrip means 21) in a direction to the right, as viewed in FIG. 10, so that sloping edge face 25*b* of the cam portion 25*a* moves the follower 35 away from the stop 36 and the follower 35 then bears against the adjacent side of the cam portion 25*a* with the result that the arm 31 is held out of the groove 15*a*. The convex edge face 23 of the guard 20 is then still remote from the concave edge face 16*a* of the abutment 16 so that the appliance 13 is ready for use, i.e., the parts 16 and 20 expose a sufficiently large portion of the tool 19 to allow for the slicing of bread or the like as soon as the trip 15 is depressed in order to close the switch SW and to thereby start the motor EM.

If the operator wishes to prevent depression of the trip 15 from its operative position while the guard 20 remains properly attached to the housing 14, the handgrip means 21 is engaged to shift the guard from the second position of FIG. 11 to the first position of FIG. 12 by moving the guard in a direction to the right, as viewed in FIG. 11. The follower 35 then tracks a sloping portion 37 of the face 24 of the cam 25 under the bias of the spring 33 and returns into engagement with the stop 36 of the front wall 27 (see FIG. 12). The arm 31 is returned into the groove 15*a* of the trip 15 and the convex edge face 23 of the guard 20 is closely or immediately adjacent to the concave edge face 16*a* of the abutment 16 so that the parts 16 and 20 cooperate to prevent access to the tool 19 from the front side (FIGS. 1 and 2) of the appliance 13. Thus, the blocking means including the bolt 30 and its arm 31 is effective not only in the third position of the guard 20, when the latter is ready to be detached from the housing 14, but also in the first position in which the guard prevents access to the tool 19.

If the operator wishes to use the appliance 13, the handgrip means 21 is engaged to move the guard 20 from the first position of FIG. 12 to the second position of FIG. 11 whereby the inclined portion 37 of the cam face 24 lifts the follower 35 off the stop 36 and guides it against the rear side of the cam portion 25*a* which entails automatic expulsion of the arm 31 from the groove 15*a*.

Should the operator desire to detach the guard 20 from the housing 14, the handgrip means 21 is shifted in a direction to the left, as viewed in FIG. 11, so that the portion 25*a* of the cam 25 moves beyond the follower 35 and the latter is again free to return into contact with the stop 36 under the action of the spring 33. Thus, the trip 15 is blocked in the inoperative position not later than when the guard 20 reaches the (third) position in which it can be detached from the front wall 27 of the housing 14. Detachment of the guard 20 from the front wall 27 entails at least substantial exposure of the tool 19, i.e., the latter is then accessible for the purpose of inspection, cleaning or replacement.

It will be readily appreciated that the illustrated appliance is susceptible of many additional modifications without departing from the spirit of the invention. Thus, the configuration of the cam 25 and its cam face 24 can be altered in a number of ways as long as the guard 20 or an equivalent guide can cooperate with the blocking means to prevent depression of the trip 15 to its operative position except at such time when the appliance 13 is ready for use, i.e., when the guard 20 is properly but separably coupled to the housing 14 and is held in that position in which it cooperates with the abutment 16 to provide a gap wide enough for proper slicing of a loaf of bread or the like. Moreover, the stop 36 can be provided on another part of the housing 14 and its configuration can depart from that which is shown in the drawing. The inclination of the sloping cam face portion 37 can be changed within a wide range, as long as it enables the cam 25 to shift the bolt 30 to the non-blocking position of FIG. 11 in response to movement of the guard 20 from its first (FIG. 12) to its second (FIG. 11) position. Still further, the illustrated blocking means including the bolt 30 and its arm 31 can be replaced with other types of (simpler or more complex) blocking means, as long as such blocking means can properly cooperate with the housing 14 and/or with the guard 20 to prevent depression of the trip 15 and starting of the motor for the tool 19 or another mobile tool when such starting is not desirable or dangerous. Last but not least, the improved guard 20 and the blocking means 30, 31 or equivalent blocking means can be used with equal or similar advantage in many other types of appliances wherein it is desirable to prevent movements of one or more tools or the like in several positions of the guard.

An important advantage of the improved appliance is that the operator need not worry about the motor EM when the guard 20 is removed, i.e., when the tool 19 is accessible for cleaning, removal or reattachment to the output element of the transmission in the housing 14. In addition, the operator need not be concerned about the motor EM when she or he decides to conceal (prevent access to) the tool in a manner as shown in FIG. 2. Such concealment of the tool 19 also entails automatic blocking of the trip 15 to thus prevent accidental starting of the motor EM when such starting is evidently unnecessary and undesirable.

Another important advantage of the improved appliance is that the blocking of the trip 15 need not be terminated in automatic response to attachment of the guard 20 to the housing 14. Thus, and as described hereinabove, it is preferred to construct the cam 25 on the guard 20 in such a way that the guard must be shifted in its plane (which is preferably parallel to the vertical plane of the tool 19) after it assumes the third position in order to assume the second position of FIG. 11 in which the follower 35 of the bolt 30 bears against the cam portion 25*a* and is held against movement into engagement with the stop 36 of the front wall 27. The extent to which the portion 25*a* of the cam 25 extends rearwardly beyond the stop 36 of the front wall 27 can be readily selected in such a way that the cam portion 25*a* invariably expels the arm 31 from the groove 15*a* when the guard 20 is held in the second position of FIG. 11.

For the sake of convenience of manufacture and lower cost, the arm 31 preferably constitutes an integral part of the locking bolt 30.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An appliance, such as a household slicing machine, comprising a support; a tool movably mounted in said support; a protective guard for said tool, said guard being mounted on said support and being movable relative to said support between a first position in which it prevents access to said tool and a second position in which said tool is at least partly exposed; actuating means for initiating the movement of said tool relative to said support, said actuating means being movable between an operative and an inoperative position; and means for blocking the movement of said actuating means from said inoperative position to said operative position in response to movement of said guard to said first position.

2. The appliance of claim 1, further comprising means for movably coupling said guard to said support in the first and second positions of said guard, said guard being further movable to a third position in which said coupling means allows for its separation from said support.

3. The appliance of claim 2, wherein said second position is located between said first and third positions so that said guard advances in a first direction during movement from said second position to said first position and in a second direction counter to said first direction during movement from said second position to said third position.

4. The appliance of claim 1, wherein said blocking means includes follower means and said guard comprises cam means, said follower means being arranged to track said cam means during movement of said guard between said first and second positions.

5. The appliance of claim 4, wherein said support includes a housing having a wall and said guard is adjacent to said wall in said first and second positions thereof, and further comprising guide means for movably coupling said guard to said housing, said guide means including a portion of said guard and a track provided on said housing for said portion of said guard.

6. The appliance of claim 1 wherein said guard is a one-piece member and includes handgrip means for facilitating its movement between said first and second positions.

7. The appliance of claim 6, wherein said one-piece member consists of a synthetic plastic material.

8. The appliance of claim 1, wherein said support includes a housing having a detachable wall and further comprising means for separably coupling said guard to said wall so that the guard is movable between said first and second positions, said wall including stop means for said blocking means and further comprising displacing means for biasing said blocking means against said stop means in the first position of said guard, said blocking means being arranged to block the movement of said actuating means from said inoperative position when it abuts against said stop means.

9. The appliance of claim 8, wherein said guard is further movable to a third position in which it is separable from said wall and said guard comprises cam means arranged to move said blocking means away from engagement with said stop means and to thereby permit said actuating means to leave its inoperative position in response to movement of said guard from said third to said second position.

10. The appliance of claim 1, wherein said actuating means is mounted in said support and said blocking means comprises a reciprocable bolt which is mounted in said support and has a front end portion engageable by said guard and a rear end portion, means for biasing said rear end portion so as to urge said front end portion toward said guard, and a projection provided on said bolt and arranged to move into the path of movement of said actuating means from inoperative to operative position when said guard assumes said first position, said guard including means for shifting said bolt against the opposition of said biasing means in response to movement from said first to said second position.

11. The appliance of claim 10, wherein said support includes a housing having a wall adjacent to said guard and having a bearing through which said bolt extends, and further comprising means for separably coupling said guard to said wall.

12. The appliance of claim 10, wherein said projection includes an arm which extends substantially at right angles to said bolt.

13. The appliance of claim 10, wherein said support has a socket adjacent to the rear end portion of said bolt and said biasing means includes a coil spring having a first portion received in said socket and a second portion bearing against the rear end portion of said bolt.

14. The appliance of claim 1, wherein said tool includes a disc-shaped knife which is rotatable in a first substantially vertical plane and said guard is disposed in a second substantially vertical plane which is parallel to said first vertical plane.

15. The appliance of claim 1, further comprising electric motor means for driving said tool and switch means in circuit with said motor means and being operable to complete such circuit in response to movement of said actuating means to said operative position.

16. The appliance of claim 15, wherein said support includes a housing for said motor means, said switch means and a portion of said tool.

17. The appliance of claim 1, further comprising abutment means provided on said support and cooperating with said guard in the first position of the latter to prevent access to said tool.

18. An appliance, such as a household slicing machine, comprising a support; a rotary tool mounted in said support and disposed in a first plane; a protective guard for said tool, said guard being movable relative to said support between a first position in which it prevents access to said tool and a second position in which said tool is at least partly exposed, said guard including a substantially plate-like member and said support including guide means defining for said member a path for movement of said member between said first and second positions in a second plane which is at least substantially parallel to said first plane; actuating means for initiating the movement of said tool relative to said support, said actuating means being movable between an operative and an inoperative position; and means for blocking the movement of said actuating means from said inoperative position to said operative position in response to movement of said guard to said first position.

19. An appliance, such as a household slicing machine, comprising a support; a tool movably mounted in said support; a protective guard for said tool, said guard being movable relative to said support between a first position in which it prevents access to said tool and a second position in which said tool is at least partly exposed; means for movably coupling said guard to said support in the first and second positions of said guard, said guard being further movable to a third position in which said coupling means allows for its separation from said support; actuating means for initiating the movement of said tool relative to said support, said actuating means being movable between an operative and an inoperative position; means for blocking the movement of said actuating means from said inoperative position to said operative position in response to movement of said guard to said first position; and displacing means for yieldably urging said blocking means to a blocking position in which said blocking means prevents said actuating means from leaving said inoperative position, said displacing means being arranged to maintain said blocking means in said blocking position when said guard assumes said third position so that said actuating means can leave said inoperative position only in said second position.

20. An appliance, such as a household slicing machine, comprising a support; a tool movably mounted in said support; a protective guard for said tool, said guard having cam means and being movable relative to said support between a first position in which it prevents access to said tool and a second position in which said tool is at least partly exposed; actuating means for initiating the movement of said tool relative to said support, said actuating means being movable between an operative and an inoperative position; and means for blocking the movement of said actuating means from said inoperative position to said operative position in response to movement of said guard to said first position, said blocking means comprising follower means arranged to track said cam means during movement of said guard between said first and second positions, said cam means having a cam face which is engaged by said follower means and said cam face including a sloping portion which shifts said follower means and said blocking means in response to movement of said guard from said first to said second position so that said blocking means ceases to block the movement of said actuating means from said inoperative position.

* * * * *